US010710155B2

(12) United States Patent
Takashita et al.

(10) Patent No.: US 10,710,155 B2
(45) **Date of Patent: *Jul. 14, 2020**

(54) MIXED POWDER FOR POWDER METALLURGY, SINTERED BODY, AND METHOD OF MANUFACTURING SINTERED BODY

(71) Applicant: JFE STEEL CORPORATION, Chiyoda-ku, Tokyo (JP)

(72) Inventors: Takuya Takashita, Tokyo (JP); Akio Kobayashi, Tokyo (JP); Naomichi Nakamura, Tokyo (JP); Itsuya Sato, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 25 days.

This patent is subject to a terminal disclaimer.

(21) Appl. No.: 15/739,839

(22) PCT Filed: Sep. 16, 2016

(86) PCT No.: PCT/JP2016/004258
§ 371 (c)(1),
(2) Date: Dec. 26, 2017

(87) PCT Pub. No.: WO2017/047100
PCT Pub. Date: Mar. 23, 2017

(65) Prior Publication Data

US 2018/0193908 A1 Jul. 12, 2018

(30) Foreign Application Priority Data

Sep. 18, 2015 (JP) ..... 2015-185636

(51) Int. Cl.

| | |
|---|---|
| ***B22F 1/00*** | (2006.01) |
| ***C22C 38/16*** | (2006.01) |
| ***C22C 38/00*** | (2006.01) |
| ***B22F 3/16*** | (2006.01) |
| ***C22C 33/02*** | (2006.01) |
| ***C22C 38/12*** | (2006.01) |

(52) U.S. Cl.
CPC ..... *B22F 1/0011* (2013.01); *B22F 3/16* (2013.01); *C22C 33/0264* (2013.01); *C22C 38/00* (2013.01); *C22C 38/12* (2013.01); *C22C 38/16* (2013.01); *B22F 2301/10* (2013.01); *B22F 2301/35* (2013.01); *B22F 2302/40* (2013.01); *B22F 2304/10* (2013.01); *B22F 2998/10* (2013.01)

(58) Field of Classification Search
None
See application file for complete search history.

(56) References Cited

U.S. PATENT DOCUMENTS

| | | | | |
|---|---|---|---|---|
| 3,212,876 | A | 10/1965 | Ingvar Hulthen Sven et al. | |
| 7,867,314 | B2 | 1/2011 | Ono et al. | |
| 8,747,516 | B2 | 6/2014 | Ono et al. | |
| 10,207,328 | B2 * | 2/2019 | Takashita | B22F 1/0014 |
| 10,265,766 | B2 | 4/2019 | Maetani et al. | |
| 2002/0043131 | A1 | 4/2002 | Nakamura et al. | |
| 2003/0056621 | A1 * | 3/2003 | Nakamura | C22C 33/0207 75/255 |
| 2004/0112173 | A1 | 6/2004 | Maulik | |
| 2005/0039576 | A1 * | 2/2005 | Unami | C22C 33/0207 75/246 |
| 2007/0089562 | A1 | 4/2007 | Unami et al. | |
| 2008/0175740 | A1 * | 7/2008 | Ruthner | C01G 49/02 419/63 |
| 2008/0233421 | A1 | 9/2008 | Tanino et al. | |
| 2009/0041608 | A1 | 2/2009 | Ozaki et al. | |
| 2010/0080725 | A1 * | 4/2010 | Fujitsuka | B22F 5/008 419/11 |

(Continued)

FOREIGN PATENT DOCUMENTS

| | | | |
|---|---|---|---|
| CA | 2355562 | A1 | 2/2002 |
| CA | 2476836 | A1 | 2/2005 |

(Continued)

OTHER PUBLICATIONS

Jan. 23, 2019, Office Action issued by the Canadian Intellectual Property Office in the corresponding Canadian Patent Application No. 2,992,092.
May 8, 2019, Office Action issued by the China National Intellectual Property Administration in the corresponding Chinese Patent Application No. 201680049635.8 with English language search report.
Dec. 13, 2016, International Search Report issued in the International Patent Application No. PCT/JP2016/004258.
Sep. 23, 2019, Office Action issued by the Korean Intellectual Property Office in the corresponding Korean Patent Application No. 10-2018-7005232 with English language concise statement of relevance.

(Continued)

*Primary Examiner* — Patricia L. Hailey
*Assistant Examiner* — Christopher Douglas Moody
(74) *Attorney, Agent, or Firm* — Kenja IP Law PC

(57) ABSTRACT

Provided is a mixed powder for powder metallurgy having a chemical system not using Ni which causes non-uniform metallic microstructure in a sintered body. A mixed powder for powder metallurgy comprises: a partially diffusion alloyed steel powder in which Mo diffusionally adheres to a particle surface of an iron-based powder; a Cu powder; and a graphite powder, wherein the mixed powder for powder metallurgy has a chemical composition containing Mo: 0.2 mass % to 1.5 mass %, Cu: 0.5 mass % to 4.0 mass %, and C: 0.1 mass % to 1.0 mass %, with the balance consisting of Fe and inevitable impurities, and the partially diffusion alloyed steel powder has: a mean particle diameter of 30 μm to 120 μm; a specific surface area of less than 0.10 $m^2/g$; and a circularity of particles with a diameter in a range from 50 μm to 100 μm of 0.65 or less.

16 Claims, No Drawings

(56) References Cited

U.S. PATENT DOCUMENTS

| | | | | |
|---|---|---|---|---|
| 2010/0284239 | A1 | 11/2010 | Maeda et al. | |
| 2011/0103995 | A1 | 5/2011 | Klekovkin et al. | |
| 2011/0314965 | A1 | 12/2011 | Nakamura | |
| 2012/0048063 | A1* | 3/2012 | Maetani | C22C 33/0271 75/246 |
| 2012/0107168 | A1 | 5/2012 | Shirasaka | |
| 2012/0286191 | A1* | 11/2012 | Maeda | H01F 1/0552 252/62.54 |
| 2013/0180359 | A1 | 7/2013 | Suzuki | |
| 2014/0238192 | A1* | 8/2014 | Otsuka | C22C 23/02 75/249 |
| 2015/0314372 | A1* | 11/2015 | Ono | B22F 1/0011 428/403 |
| 2016/0136727 | A1 | 5/2016 | Maetani et al. | |
| 2016/0214171 | A1 | 7/2016 | Maetani et al. | |
| 2017/0259340 | A1* | 9/2017 | Takashita | B22F 1/0014 |
| 2018/0178291 | A1* | 6/2018 | Takashita | B22F 3/24 |
| 2018/0193911 | A1* | 7/2018 | Kobayashi | C22C 33/02 |
| 2018/0221960 | A1* | 8/2018 | Machida | B22F 9/22 |

FOREIGN PATENT DOCUMENTS

| | | | | |
|---|---|---|---|---|
| CA | 2832433 | A1 | 10/2012 | |
| CA | 2922018 | A1 | 4/2015 | |
| CA | 2911031 | C | 1/2018 | |
| CN | 2445270 | Y | 8/2001 | |
| CN | 101801566 | A | 8/2010 | |
| CN | 101896299 | A | 11/2010 | |
| CN | 103506618 | A | 1/2014 | |
| JP | H04285141 | A | 10/1992 | |
| JP | H056816 | A | 1/1993 | |
| JP | H07310101 | A | 11/1995 | |
| JP | 3651420 | B2 | 5/2005 | |
| JP | 3663929 | B2 | 6/2005 | |
| JP | 2006257539 | A | 9/2006 | |
| JP | 2008231538 | A | 10/2008 | |
| JP | 2014237878 | A | 12/2014 | |
| JP | 2015014048 | A | 1/2015 | |
| JP | 5949952 | B2 | 7/2016 | |
| JP | 6227903 | B2 | 11/2017 | |
| KR | 1020080085920 | A | 9/2008 | |
| WO | 2012063628 | A1 | 5/2012 | |
| WO | WO-2014103287 | A1 * | 7/2014 | B22F 1/0011 |
| WO | 2015045273 | A1 | 4/2015 | |
| WO | WO-2016088333 | A1 * | 6/2016 | B22F 1/00 |

OTHER PUBLICATIONS

V. B. Akimenko et al., Reduced Iron Powder: Manufacturing Problems and Prospects, Steel in Translation, 2011, pp. 622 to 626, vol. 41, No. 7.

Mar. 19, 2020, Office Action issued by the United States Patent and Trademark Office in the U.S. Appl. No. 15/738,739.

* cited by examiner

MIXED POWDER FOR POWDER METALLURGY, SINTERED BODY, AND METHOD OF MANUFACTURING SINTERED BODY

TECHNICAL FIELD

This disclosure relates to a mixed powder for powder metallurgy, and relates in particular to a mixed powder for powder metallurgy suitable for manufacturing high strength sintered parts for automobiles, the mixed powder for powder metallurgy having reliably improved density of a sintered body obtained by forming and sintering the alloy steel powder and having reliably improved tensile strength and toughness (impact energy value) after performing the processes of carburizing, quenching, and tempering on the sintered body, and a sintered body produced using the mixed powder for powder metallurgy. Further, this disclosure relates to a method of manufacturing the sintered body.

BACKGROUND

Powder metallurgical techniques enable producing parts with complicated shapes in shapes that are extremely close to product shapes (so-called near net shapes) with high dimensional accuracy, and consequently significantly reducing machining costs. For this reason, powder metallurgical products are used for various machines and parts in many fields.

In recent years, there is a strong demand for powder metallurgical products to have improved toughness in terms of improving the strength for miniaturizing parts and reducing the weight thereof and safety. In particular, for powder metallurgical products (iron-based sintered bodies) which are very often used for gears and the like, in addition to higher strength and higher toughness, there is also a strong demand for higher hardness in terms of wear resistance. In order to meet the above-mentioned demands, iron-based sintered bodies of which components, structures, density and the like are controlled suitably are required to be developed, since the strength and toughness of an iron-based sintered body varies widely depending on those properties.

Typically, a green compact before being subjected to sintering is produced by mixing iron-based powder with alloying powders such as copper powder and graphite powder and a lubricant such as stearic acid or lithium stearate to obtain mixed powder; filling a mold with the mixed powder; and compacting the powder.

The density of a green compact obtained through a typical powder metallurgical process is usually around 6.6 $Mg/m^3$ to 7.1 $Mg/m^3$. The green compact is then sintered to form a sintered body which in turn is further subjected to optional sizing or cutting work, thereby obtaining a powder metallurgical product. Further, when even higher strength is required, carburizing heat treatment or bright heat treatment may be performed after sintering.

Based on the components, iron-based powders used here are categorized into iron powder (e.g. iron-based powder and the like) and alloy steel powder. Further, when categorized by production method, iron-based powders are categorized into atomized iron powder and reduced iron powder. Within these categories specified by production methods, the term "iron powder" is used with a broad meaning encompassing alloy steel powder as well as iron-based powder.

In terms of obtaining a sintered body with high strength and high toughness, it is advantageous that iron-based powder being a main component in particular allows alloying of the powder to be promoted and high compressibility of the powder to be maintained.

First, known iron-based powders obtained by alloying include:

(1) mixed powder obtained by adding alloying element powders to iron-based powder, (2) pre-alloyed steel powder obtained by completely alloying alloying elements, (3) partially diffusion alloyed steel powder (also referred to as composite alloy steel powder) obtained by partially adding alloying element powders in a diffused manner to the surface of particles of iron-based powder or pre-alloyed steel powder.

The mixed powder (1) mentioned above advantageously has high compressibility equivalent to that of pure iron powder. However, in sintering, the alloying elements are not sufficiently diffused in Fe and form a non-uniform microstructure, which would result in poor strength of the resulting sintered body. Further, since Mn, Cr, V, Si, and the like are more easily oxidized than Fe, when these elements are used as the alloying elements, they get oxidized in sintering, which would reduce the strength of the resulting sintered body. In order to suppress the oxidation and reduce the amount of oxygen in the sintered body, it is necessary that the atmosphere for sintering, and the $CO_2$ concentration and the dew point in the carburizing atmosphere are strictly controlled in the case of performing carburizing after sintering. Accordingly, the mixed powder (1) mentioned above cannot meet the demands for higher strength in recent years and has become unused.

On the other hand, when the pre-alloyed steel powder obtained by completely alloying the elements of (2) mentioned above is used, the alloying elements can be completely prevented from being segregated, so that the microstructure of the sintered body is made uniform, leading to stable mechanical properties. In addition, also in the case where Mn, Cr, V, Si, and the like are used as the alloying elements, the amount of oxygen in the sintered body can be advantageously reduced by limiting the kind and the amount of the alloying elements. However, when the pre-alloyed steel powder is produced by atomization from molten steel, oxidation in the atomization of the molten steel and solid solution hardening of steel powder due to complete alloying would be caused, which makes it difficult to increase the density of the green compact after compaction (forming by pressing). When the density of the green compact is low, the toughness of the sintered body obtained by sintering the green compact is low. Therefore, also when the pre-alloyed steel powder is used, demands for higher strength and higher toughness cannot be met.

The partially diffusion alloyed steel powder (3) mentioned above is produced by adding alloying elements to iron-based powder or pre-alloyed steel powder, followed by heating under a non-oxidizing or reducing atmosphere, thereby partially diffusion bonding the alloying element powders to the surface of particles of iron-based powder or pre-alloyed steel powder. Accordingly, advantages of the iron-based mixed powder of (1) above and the pre-alloyed steel powder of (2) above can be obtained.

Thus, when the partially diffusion pre-alloyed steel powder is used, oxygen in the sintered body can be reduced and the green compact can have a high compressibility equivalent to the case of using pure iron powder. Therefore, the sintered body has a multi-phase structure consisting of a completely alloyed phase and a partially concentrated phase, increasing the strength of the sintered body.

As basic alloy components used in the partially diffusion alloyed steel powder, Ni and Mo are used heavily.

Ni has the effect of improving the toughness of a sintered body. Adding Ni stabilizes austenite, which allows more austenite to remain as retained austenite without transforming to martensite after quenching. Further, Ni serves to strengthen the matrix of a sintered body by solid solution strengthening.

Meanwhile, Mo has the effect of improving hardenability. Accordingly, Mo suppresses the formation of ferrite during quenching, allowing bainite or martensite to be easily formed, thereby strengthening the matrix of the sintered body. Further, Mo is contained as a solid solution in a matrix to solid solution strengthen the matrix, and forms fine carbides to strengthen the matrix by precipitation.

As an example of the mixed powder for high strength sintered parts using the above-described partially diffusion alloyed steel powder, JP 3663929 B2 (PTL 1) discloses mixed powder for high strength sintered parts obtained by mixing Ni: 1 mass % to 5 mass %, Cu: 0.5 mass % to 4 mass %, and graphite powder: 0.2 mass % to 0.9 mass % to alloy steel powder in which Ni: 0.5 mass % to 4 mass % and Mo: 0.5 mass % to 5 mass % are partially alloyed. The sintered material described in PTL 1 contains 1.5 mass % of Ni at minimum, and substantially contains 3 mass % or more of Ni according to Examples of PTL 1. This means that a large amount of Ni as much as 3 mass % or more is required to obtain a sintered body having a high strength of 800 MPa or more. Further, obtaining a material having a high strength of 1000 MPa or more by subjecting a sintered body to carburizing, quenching, and tempering also requires a large amount of Ni as much as for example 3 mass % or 4 mass %.

However, Ni is an element which is disadvantageous in terms of addressing recent environmental problems and recycling, so its use is desirably avoided as possible. Also in respect of cost, adding several mass % of Ni is significantly disadvantageous. Further, when Ni is used as an alloying element, sintering is required to be performed for a long time in order to sufficiently diffuse Ni in iron powder or steel powder. Moreover, when Ni being an austenite phase stabilizing element is not sufficiently diffused, a high Ni concentration area is stabilized as the austenite phase (hereinafter also referred to as γ phase) and the other area where Ni is hardly contained is stabilized as other phases, resulting in a non-uniform metal structure in the sintered body.

As a Ni-free technique, JP 3651420 B2 (PTL 2) discloses a technique associated with partially diffusion alloyed steel powder of Mo free of Ni. That is, PTL 2 states that optimization of the Mo content results in a sintered body having high ductility and high toughness that can resist repressing after sintering.

Further, regarding a high density sintered body free of Ni, JP H04-285141 A (PTL 3) discloses mixing iron-based powder having a mean particle diameter of 1 μm to 18 μm with copper powder having a mean particle diameter of 1 μm to 18 μm at a weight ratio of 100:(0.2 to 5), and compacting the mixed powder and sintering the green compact. In the technique disclosed in PTL 3, iron-based powder having a mean particle diameter that is extremely smaller than that of typical one is used, so that a sintered body having a density as extremely high as 7.42 g/cm$^3$ or more can be obtained.

WO 2015/045273 A1 (PTL 4) discloses that a sintered body having high strength and high toughness is obtained using powder free of Ni, in which Mo is adhered to the surface of iron-based powder particles by diffusion bonding to achieve a specific surface area of 0.1 m$^2$/g or more.

Further, J P 2015-014048 A (PTL 5) discloses that a sintered body having high strength and high toughness is obtained using powder in which Mo is adhered to iron-based powder particles containing reduced iron powder by diffusion bonding.

CITATION LIST

Patent Literature

PTL 1: JP 3663929 B2
PTL 2: JP 3651420 B2
PTL 3: JP H04-285141 A
PTL 4: WO 2015/045273 A1
PTL 5: JP 2015-014048 A

SUMMARY

Technical Problem

However, the alloyed powder and sintered materials obtained in accordance with the description of PTL 2, PTL 3, PTL 4, and PTL 5 above have been found to have the following respective problems.

The technique disclosed in PTL 2 does not involve the addition of Ni, but is designed to achieve high strength by recompression after sintering. Accordingly, when a sintered material is manufactured by a typical metallurgical process, sufficient strength, toughness, and hardness are hardly achieved at the same time.

Further, the iron-based powder used for the sintered material described in PTL 3 contains no Ni, but has a mean particle diameter of 1 μm to 18 μm which is smaller than normal. Such a small particle diameter causes lower fluidity of the mixed powder, and decreases work efficiency when filling the die with the mixed powder upon pressing.

Further, since the powder described in PTL 4 has extremely large specific surface area, use of such powder results in low flowability of the powder and reduced handleability of the powder.

Also for the sintered body described in PTL 5, as with the technique described in PTL 4, reduced iron powder having extremely large specific surface area is used, which results in low flowability of the powder and reduced handleability of the powder.

It could therefore be helpful to provide a mixed powder for powder metallurgy that, despite having a chemical system not using Ni (hereafter also referred to as "Ni-free") which causes non-uniform metallic microstructure in a sintered body and is a main factor in increasing the cost of an alloy powder, enables a part obtained by sintering a green compact of the alloy steel powder and carburizing, quenching, and tempering the sintered body to have at least as high mechanical properties as a Ni-added part. It could also be helpful to provide an iron-based sintered body produced using the mixed powder and having excellent mechanical properties.

Solution to Problem

We conducted various studies on alloy components of a mixed powder for powder metallurgy not containing Ni, addition means, and powder 5 properties. Consequently, we conceived producing a mixed powder for powder metallurgy by, while not using Ni, limiting the mean particle diameter, specific surface area, and circularity of a partially diffusion alloyed steel powder partially alloyed with Mo, and mixing the partially diffusion alloyed steel powder with a Cu powder together with a graphite powder.

In detail, we made the following discoveries. Mo functions as a ferrite-stabilizing element during sintering heat treatment. Hence, ferrite phase forms in a portion having a large amount of Mo and its vicinity to facilitate the sintering of the iron powder, as a result of which the density of the sintered body increases. Moreover, by limiting the circularity of the partially diffusion alloyed steel powder to low circularity, coarse holes which cause a decrease in toughness in the sintered body can be reduced. Furthermore, by limiting the specific surface area of the partially diffusion alloyed steel powder to less than or equal to a specific value, compressibility during forming can be improved. In addition, by limiting the mean particle diameter of the partially diffusion alloyed steel powder to 30 μm or more, the fluidity of the alloy steel powder can be improved.

This disclosure is based on the aforementioned discoveries and further studies. Specifically, the primary features of this disclosure are described below.

1. A mixed powder for powder metallurgy, comprising: a partially diffusion alloyed steel powder in which Mo diffusionally adheres to a particle surface of an iron-based powder; a Cu powder; and a graphite powder, wherein the mixed powder for powder metallurgy has a chemical composition containing (consisting of) Mo in an amount of 0.2 mass % to 1.5 mass %, Cu in an amount of 0.5 mass % to 4.0 mass %, and C in an amount of 0.1 mass % to 1.0 mass %, with the balance consisting of Fe and inevitable impurities, and the partially diffusion alloyed steel powder has: a mean particle diameter of 30 μm to 120 μm; a specific surface area of less than 0.10 $m^2/g$; and a circularity of particles with a diameter in a range from 50 μm to 100 μm of 0.65 or less.

2. The mixed powder for powder metallurgy according to 1., wherein the Cu powder has a mean particle diameter of 50 μm or less.

3. The mixed powder for powder metallurgy according to 1. or 2., wherein the iron-based powder is at least one of an as-atomized powder and an atomized iron powder.

4. A sintered body of a green compact that comprises the mixed powder for powder metallurgy according to any of 1. to 3.

5. A method of manufacturing a sintered body, comprising sintering a green compact of a mixed powder for powder metallurgy that includes: a partially diffusion alloyed steel powder in which Mo diffusionally adheres to a particle surface of an iron-based powder; a Cu powder; and a graphite powder, wherein the mixed powder for powder metallurgy has a chemical composition containing Mo: 0.2 mass % to 1.5 mass %, Cu: 0.5 mass % to 4.0 mass %, and C: 0.1 mass % to 1.0 mass %, with the balance consisting of Fe and inevitable impurities, and the partially diffusion alloyed steel powder has: a mean particle diameter of 30 μm to 120 μm; a specific surface area of less than 0.10 $m^2/g$; and a circularity of particles with a diameter in a range from 50 μm to 100 μm of 0.65 or less.

6. The method of manufacturing a sintered body according to 5., wherein the Cu powder has a mean particle diameter of 50 μm or less.

7. The method of manufacturing a sintered body according to 5. or 6., wherein the iron-based powder is at least one of an as-atomized powder and an atomized iron powder.

Advantageous Effect

It is possible to obtain a mixed powder for powder metallurgy that, despite having a Ni-free chemical system which does not use Ni, enables the production of a sintered body having excellent properties at least as high as those in the case of containing Ni. The mixed powder for powder metallurgy has high fluidity, and so contributes to excellent work efficiency when charging the mixed powder for powder metallurgy into a die for pressing. Moreover, a sintered body having both excellent strength and excellent toughness can be produced at low cost, even with an ordinary sintering method.

DETAILED DESCRIPTION

Our methods and products will be described in detail below.

A mixed powder for powder metallurgy according to this disclosure is obtained by mixing a partially diffusion alloyed steel powder (hereafter also referred to as "partially alloyed steel powder") in which Mo diffusionally adheres to the surface of an iron-based powder and that has an appropriate mean particle diameter and specific surface area, with a Cu powder and a graphite powder.

In particular, the partially diffusion alloyed steel powder needs to have: a mean particle diameter of 30 μm to 120 μm; a specific surface area of less than 0.10 $m^2/g$; and a circularity of particles with a diameter in a range from 50 μm to 100 μm of 0.65 or less. Moreover, the mixed powder for powder metallurgy needs to have a chemical composition containing Mo: 0.2 mass % to 1.5 mass %, Cu: 0.5 mass % to 4.0 mass %, and C: 0.1 mass % to 1.0 mass %, with the balance being Fe and inevitable impurities.

A sintered body according to this disclosure is produced by subjecting the mixed powder for powder metallurgy to conventional pressing to obtain a green compact and further subjecting the green compact to conventional sintering. Here, since a Mo-concentrated portion is formed in a sintered neck part between the particles of the iron-based powder of the green compact and the circularity of the partially diffusion alloyed steel powder is low, the entanglement of particles during pressing intensifies, thus facilitating subsequent sintering.

When the density of the sintered body increases in this way, the strength and toughness of the sintered body both increase. Unlike a conventional sintered body produced using Ni, the sintered body according to this disclosure has uniform metallic microstructure and so exhibits stable mechanical properties with little variation.

Mixed powder for powder metallurgy according to this disclosure will now be described in detail. Note that "%" herein means "mass %" unless otherwise specified. Accordingly, the Mo content, the Cu content, and the graphite powder content each represents the proportion of the element in the entire mixed powder for powder metallurgy (100 mass %).

(Iron-Based Powder)

As described above, the partially diffusion alloyed steel powder is obtained by adhering Mo to the surface of particles of the iron-based powder, and it is important that the mean particle diameter is 30 μm to 120 μm, the specific surface area is less than 0.10 $m^2/g$, and particles having a diameter in a range of 50 μm to 100 μm have a circularity of 0.65 or less. Here, when the iron-based powder is partially alloyed, the particle diameter and the circularity hardly change. Accordingly, iron-based powder having a mean particle diameter and a circularity in the same range as that of the partially diffusion alloyed steel powder is used.

First, the iron-based powder preferably has a mean particle diameter of 30 μm to 120 μm and particles having a diameter in a range of 50 μm to 100 μm preferably have a circularity (roundness of the cross section) of 0.65 or less. For the reasons described below, the partially alloyed steel powder is required to have a mean particle diameter of 30 μm to 120 μm and particles having a diameter in a range of 50 μm to 100 μm are required to have a circularity of 0.65 or less. Accordingly, the iron-based powder is also required to meet those conditions.

Here, the mean particle diameter of the iron-based powder and the partially alloyed steel powder refers to the median size D50 determined from the cumulative weight distribution, and is a particle diameter found by determining the particle size distribution using a sieve according to JIS Z 8801-1, producing the integrated particle size distribution from the resulting particle size distribution, and finding the particle diameter obtained when the oversized particles and the undersized particles constitute 50% by weight each.

Further, the circularity of the particles of iron-based powder and partially alloyed steel powder can be determined as follows. Although a case of iron-based powder is explained by way of example, the circularity of partially alloyed steel powder particles is also determined through the same process.

First, iron-based powder is embedded in a thermosetting resin. On this occasion, the iron-based powder is embedded to be uniformly distributed in an area with a thickness of 0.5 mm or more in the thermosetting resin so that a sufficient number of cross sections of the iron-based powder particles can be observed in an observation surface exposed by polishing the powder-embedded resin. After that, the resin is polished to expose a cross section of the iron-based powder particles; the cross section of the resin is mirror polished; and the cross section is magnified and imaged by an optical microscope. The cross sectional area A and the peripheral length Lp of the iron-based powder particles in the resulting micrograph of the cross section are determined by image analysis. Examples of software capable of such image analysis include ImageJ (open source, National Institutes of Health). The circle equivalent diameter dc is calculated from the determined cross-sectional area A. Here, dc is calculated by the equation (I).

$$d_e=2\sqrt{A/\pi} \quad \text{(I)}$$

Next, the peripheral length of a circular approximation of each powder particle Lc is calculated by multiplying the particle diameter dc by the number π. The circularity C is calculated from the determined Lc and the peripheral length Lp of the cross section of each iron-based powder particle. Here, the circularity C is a value defined by the following equation (II).

When the circularity C is 1, the cross-sectional shape of the particle is a perfect circle, and a smaller C value results in a more indefinite shape.

$$C=L_c/L_p \quad \text{(II)}$$

Note that iron-based powder means powder having an Fe content of 50% or more. Examples of iron-based powder include as-atomized powder (atomized iron powder as atomized), atomized iron powder (obtained by reducing as-atomized powder in a reducing atmosphere), and reduced iron powder. In particular, iron-based powder used in this disclosure is preferably as-atomized powder or atomized iron powder. This is because since reduced iron powder contains many pores in the particles, sufficient density would not be obtained during compaction. Further, reduced iron powder contains more inclusions acting as starting points of fracture in the particles than atomized iron powder, which would reduce the fatigue strength which is one of the important mechanical properties of a sintered body.

Specifically, iron-based powder preferably used in this disclosure is any one of as-atomized powder obtained by atomizing molten steel, drying the atomized molten steel, and classifying the resulting powder without performing heat treatment for e.g., deoxidation (reduction) and decarbonization; and atomized iron powder obtained by reducing as-atomized powder in a reducing atmosphere.

Iron-based powder satisfying the above-described circularity can be obtained by appropriately adjusting the spraying conditions for atomization and conditions for additional processes performed after the spraying. Further, iron-based powder having particles of different circularities may be mixed and the circularity of the particles of the iron-based powder that have a particle diameter in a range of 50 μm to 100 μm may be controlled to fall within the above-described range.

(Partially Diffusion Alloyed Steel Powder)

Partially diffusion alloyed steel powder is obtained by adhering Mo to the surface of particles of the above iron-based powder, and it is required that the mean particle diameter is 30 μm to 120 μm, the specific surface area is less than 0.10 $m^2/g$, and particles having a diameter in a range of 50 μm to 100 μm have a circularity of 0.65 or less.

Thus, the partially diffusion alloyed steel powder is produced by adhering Mo to the above iron-based powder by diffusion bonding. The Mo content is set to be 0.2% to 1.5% of the entire mixed powder for powder metallurgy (100%). When the Mo content is less than 0.2%, the hardenability and strength of a sintered body manufactured using the mixed powder for powder metallurgy are poorly improved. On the other hand, when the Mo content exceeds 1.5%, the effect of improving hardenability reaches a plateau, and the structure of the sintered body becomes rather non-uniform. Accordingly, high strength and toughness cannot be obtained. Therefore, the content of Mo adhered by diffusion bonding is set to be 0.2% to 1.5%. The Mo content is preferably 0.3% to 1.0%, more preferably 0.4% to 0.8%.

Here, Mo-containing powder can be given as an example of a Mo source. Examples of the Mo-containing powder include pure metal powder of Mo, oxidized Mo powder, and Mo alloy powders such as Fe—Mo (ferromolybdenum) powder. Further, Mo compounds such as Mo carbides, Mo sulfides, and Mo nitrides can be used as preferred Mo-containing powders. Theses material powders can be used alone; alternatively, some of these material powders can be used in a mixed form.

Specifically, the above-described iron-based powder and the Mo-containing powder are mixed in the proportions described above (the Mo content is 0.2% to 1.5% of the entire mixed powder for powder metallurgy (100%)). The mixing method is not particularly limited, and the powders can be mixed by a conventional method using a Henschel mixer, a cone blender, or the like.

Next, mixed powder of the above-described iron-based powder and the Mo-containing powder is heated so that Mo is diffused in the iron-based powder through the contact surface between the iron-based powder and the Mo-containing powder, thereby joining Mo to the iron-based powder. Partially alloyed steel powder containing Mo can be obtained by this heat treatment.

As the atmosphere for diffusion-bonding heat treatment, a reducing atmosphere or a hydrogen-containing atmosphere is preferable, and a hydrogen-containing atmosphere is particularly suitable. Alternatively, the heat treatment may be performed under vacuum.

Further, for example when a Mo compound such as oxidized Mo powder is used as the Mo-containing powder, the temperature of the heat treatment is preferably set to be in a range of 800° C. to 1100° C. When the temperature of the heat treatment is lower than 800° C., the Mo compound is insufficiently decomposed and Mo is not diffused into the iron-based powder, so that Mo hardly adheres to the iron-based powder. When the heat treatment temperature exceeds 1100° C., sintering between iron-based powder particles is promoted during the heat treatment, and the circularity of the iron-based powder particles exceeds the predetermined range. On the other hand, when a metal and an alloy, for example, Mo pure metal and an alloy such as Fe—Mo are used for the Mo-containing powder, a preferred heat treatment temperature is in a range of 600° C. to 1100° C. When the temperature of the heat treatment is lower than 600° C., Mo is not sufficiently diffused into the iron-based powder, so that Mo hardly adheres to the iron-based powder. On the other hand, when the heat treatment temperature exceeds 1100° C., sintering between iron-based powder particles is promoted during the heat treatment, and the circularity of the partially alloyed steel powder exceeds the predetermined range.

When heat treatment, that is, diffusion bonding is performed as described above, since partially alloyed steel powder particles are usually sintered together and solidified, grinding and classification are performed to obtain particles having a predetermined particle diameter described below. Specifically, in order to achieve the predetermined particle diameter, the grinding conditions are tightened or coarse powder is removed by classification using a sieve with openings of a predetermined size, as necessary. In addition, annealing may optionally be performed.

Specifically, it is important that the mean particle diameter of the partially alloyed steel powder is in a range of 30 μm to 120 μm. The lower limit of the mean particle diameter is preferably 40 μm, more preferably 50 μm. Meanwhile, the upper limit of the mean particle diameter is preferably 100 μm, more preferably 80 μm.

As described above, the mean particle diameter of the partially alloyed steel powder refers to the median size D50 determined from the cumulative weight distribution, and is a particle diameter found by determining the particle size distribution using a sieve according to JIS Z 8801-1, producing the integrated particle size distribution from the resulting particle size distribution, and finding the particle diameter obtained when the oversized particles and the undersized particles constitute 50% by weight each.

Here when the mean particle diameter of the partially alloyed steel powder particles is smaller than 30 μm, the flowability of the partially alloyed steel powder is reduced, and for example the productivity in compaction using a mold is affected. On the other hand, when the mean particle diameter of the partially alloyed steel powder particles exceeds 120 μm, the driving force is weakened during sintering and coarse pores are formed around the coarse iron-based powder particles. This reduces the sintered density and leads to reduction in the strength and toughness of a sintered body and the sintered body having been carburized, quenched, and tempered. The maximum particle diameter of the partially alloyed steel powder particles is preferably 180 μm or less.

Further, in terms of compressibility, the specific surface area of the partially alloyed steel powder particles is set to be less than 0.10 $m^2/g$. Here, the specific surface area of the partially alloyed steel powder refers to the specific surface area of particles of the partially alloyed steel powder except for additives (Cu powder, graphite powder, lubricant).

When the specific surface area of the partially alloyed steel powder exceeds 0.10 $m^2/g$, the flowability of the mixed powder for powder metallurgy is reduced. Note that the lower limit of the specific surface area is not specified; however, the lower limit of the specific surface area achieved industrially is approximately 0.010 $m^2/g$. The specific surface area can be controlled as desired by adjusting the particle size of coarse particles of more than 100 μm and fine particles of less than 50 μm after diffusion bonding by sieving. Specifically, the specific surface area is reduced by reducing the proportion of fine particles or increasing the proportion of coarse particles.

Further, particles of the partially alloyed steel powder that have a diameter of 50 μm to 100 μm are required to have a circularity of 0.65. The circularity is preferably 0.60 or less, more preferably 0.58 or less. Reducing the circularity increases the entanglement between particles during compaction and improves the compressibility of the mixed powder for powder metallurgy, so that coarse pores in the green compact and the sintered body are reduced. On the other hand, an excessively low circularity reduces the compressibility of the mixed powder for powder metallurgy. Accordingly, the circularity is preferably 0.40 or more.

The circularity of the partially alloyed steel powder particles having a diameter of 50 μm to 100 μm can be measured as follows. First, the particle diameter of the partially alloyed steel powder particles is calculated in the same manner as that of the above-described iron-based powder particles and is expressed as dc, and the partially alloyed steel powder particles having dc in a range of 50 μm to 100 μm are extracted. Here, optical microscopy imaging performed is such that at least 150 particles of the partially alloyed steel powder that have a diameter in a range of 50 μm to 100 μm can be extracted. The circularity of the extracted partially alloyed steel powder particles was calculated in the same manner as in the case of the above-described iron-based powder.

Note that the particle diameter of the partially alloyed steel powder particles is limited to 50 μm to 100 μm because reducing the circularity of the particles of this range can most effectively promote sintering. Specifically, since particles of less than 50 μm are fine particles which originally facilitate sintering, reducing the circularity of such particles of less than 50 μm does not significantly promote sintering. Further, since particles having a particle diameter exceeding 100 μm are extremely coarse, reducing the circularity of those particles does not significantly promote sintering.

The circularity of the partially alloyed steel powder can be calculated by the same method as the circularity of the iron-based powder mentioned above.

In this disclosure, the remainder components in the partially alloyed steel powder are iron and inevitable impurities. Here, impurities contained in the partially alloyed steel powder may be C (except for graphite content), O, N, S, and others, the contents of which may be set to C: 0.02% or less, O: 0.3% or less, N: 0.004% or less, S: 0.03% or less, Si: 0.2% or less, Mn: 0.5% or less, and P: 0.1% or less in the partially alloyed steel powder without any particular problem. The content of O, however, is preferably 0.25% or less. It should be noted that when the amount of inevitable impurities exceeds the above range, the compressibility in compaction using the partially alloyed steel powder decreases, which makes it difficult to obtain a green compact having sufficient density by the compaction.

In this disclosure, a sintered body manufactured using mixed powder for powder metallurgy is further subjected to carburizing, quenching, and tempering, and Cu powder and graphite powder are then added to the partially alloyed steel powder obtained as described above for the purpose of achieving a tensile strength of 1000 MPa.

(Cu Powder)

Cu is an element useful in improving the solid solution strengthening and the hardenability of iron-based powder thereby increasing the strength of sintered parts. The amount of Cu added is preferably 0.5% or more and 4.0 or less. When the amount of Cu powder added is less than 0.5%, the advantageous effects of adding Cu are hardly obtained. On the other hand, when the Cu content exceeds 4.0%, not only does the effects improving the strength of the sintered parts reach a plateau but also the density of the sintered body is reduced. Therefore, the amount of Cu powder added is limited to a range of 0.5% to 4.0%. The amount added is preferably in a range of 1.0% to 3.0%.

Further, when Cu powder of large particle size is used, in sintering a green compact of mixed powder for powder metallurgy, molten Cu penetrates between particles of the partially alloyed steel powder to expand the volume of the sintered body after sintering, which would reduce the density of the sintered body. In order to prevent the density of the sintered body from decreasing in such a way, the mean particle diameter of the Cu powder is preferably set to be 50 μm or less. More preferably, the mean particle diameter of the Cu powder is 40 μm or less, still more preferably 30 μm or less. Although the lower limit of the mean particle diameter of the Cu powder is not specified, the lower limit is preferably set to be approximately 0.5 μm in order not to increase the production cost of the Cu powder unnecessarily.

The mean particle diameter of the Cu powder can be calculated by the following method.

Since the mean particle diameter of particles having a mean particle diameter of 45 μm or less is difficult to be measured by means of sieving, the particle diameter is measured using a laser diffraction/scattering particle size distribution measurement system. Examples of the laser diffraction/scattering particle size distribution measurement system include LA-950V2 manufactured by HORIBA, Ltd. Of course, other laser diffraction/scattering particle size distribution measurement systems may be used; however, for performing accurate measurement, the lower limit and the upper limit of the measurable particle diameter range of the system used are preferably 0.1 μm or less and 45 μm or more, respectively. Using the system mentioned above, a solvent in which Cu powder is dispersed is exposed to a laser beam, and the particle size distribution and the mean particle diameter of the Cu powder are measured from the diffraction and scattering intensity of the laser beam. For the solvent in which the Cu powder is dispersed, ethanol is preferably used, since particles are easily dispersed in ethanol, and ethanol is easy to handle. When a solvent in which the Van der Waals force is strong and particles are hardly dispersed, such as water is used, particles agglomerate during the measurement, and the measurement result includes a mean particle diameter larger than the real mean particle diameter. Therefore, such a solvent is not preferred. Accordingly, it is preferable that Cu powder introduced into an ethanol solution is preferably dispersed using ultrasound before the measurement.

Since the appropriate dispersion time varies depending on the target powder, the dispersion is performed in 7 stages at 10 min intervals between 0 min and 60 min, and the mean particle diameter of the Cu powder is measured after each dispersion time stage. In order to prevent particle agglomeration, during each measurement, the measurement is performed with the solvent being stirred. Of the particle diameters obtained through the seven measurements performed by changing the dispersion time by 10 min, the smallest value is used as the mean particle diameter of the Cu powder.

(Graphite Powder)

Graphite powder is useful in increasing strength and fatigue strength, and graphite powder is added to the partially alloyed steel powder in an amount in a range of 0.1% to 1.0%, and mixing is performed. When the amount of graphite powder added is less than 0.1%, the above advantageous effects cannot be obtained. On the other hand, when the amount of graphite powder added exceeds 1.0%, the sintered body becomes hypereutectoid, and cementite is precipitated, resulting in reduced strength. Therefore, the amount of graphite powder added is limited to a range of 0.1% to 1.0%. The amount of graphite powder added is preferably in a range of 0.2% to 0.8%. Note that the particle diameter of graphite powder to be added is preferably in a range of approximately from 1 μm to 50 μm.

In this disclosure, the Cu powder and graphite powder described above are mixed with partially diffusion alloyed steel powder to which Mo is diffusionally adhered to obtain Fe—Mo—Cu—C-based mixed powder for powder metallurgy, and the mixing may be performed in accordance with conventional powder mixing methods.

Further, in a stage where a sintered body is obtained, if the sintered body needs to be further formed into the shape of parts by cutting work or the like, powder for improving machinability, such as MnS is added to the mixed powder for powder metallurgy in accordance with conventional methods.

Next, the compacting conditions and sintering conditions preferable for manufacturing a sintered body using the mixed powder for powder metallurgy according to this disclosure will be described.

In compaction using the above mixed powder for powder metallurgy, a lubricant powder may also be mixed in. Further, compaction may be performed with a lubricant being applied or adhered to a mold. In either case, as the lubricant, any of metal soap such as zinc stearate and lithium stearate, amide-based wax such as ethylenebisstearamide, and other well known lubricants may suitably be used. When mixing the lubricant, the amount thereof is preferably around from 0.1 parts by mass to 1.2 parts by mass with respect to 100 parts by mass of the mixed powder for powder metallurgy.

In manufacturing a green compact by compacting the disclosed mixed powder for powder metallurgy, the compaction is preferably performed at a pressure of 400 MPa to 1000 MPa. When the compacting pressure is less than 400 MPa, the density of the resulting green compact is reduced, and the properties of the sintered body are degraded. On the other hand, a compacting pressure exceeding 1000 MPa extremely shortens the life of the mold, which is economically disadvantageous. The compacting temperature is preferably in a range of room temperature (approximately 20° C.) to approximately 160° C.

Further, the green compact is sintered preferably at a temperature in a range of 1100° C. to 1300° C. When the sintering temperature is lower than 1100° C., sintering stops; accordingly, it is difficult to achieve the desired tensile strength: 1000 MPa or more. On the other hand, a sintering temperature higher than 1300° C. extremely shortens the life of a sintering furnace, which is economically disadvantageous. The sintering time is preferably in a range of 10 min to 180 min.

A sintered body obtained using mixed powder for powder metallurgy according to this disclosure under the above sintering conditions through such a procedure can have higher density after sintering than the case of using alloy steel powder which does not fall within the above range even if the green density is the same.

Further, the resulting sintered body may be subjected to strengthening processes such as carburized quenching, bright quenching, induction hardening, and a carbonitriding process as necessary; however, even when such strengthening processes are not performed, the sintered body using the mixed powder for powder metallurgy according to this disclosure have improved strength and toughness compared with conventional sintered bodies which are not subjected to strengthening processes. The strengthening processes may be performed in accordance with conventional methods.

EXAMPLES

A more detailed description of this disclosure will be given below with reference to examples; however, the disclosure is not limited solely to the following examples.

Example 1

As-atomized powders having particles with different circularities were used as iron-based powders. The circularity of each as-atomized powder was varied by grinding the as-atomized powder using a high speed mixer (LFS-GS-2J manufactured by Fukae Powtec Corp.).

Oxidized Mo powder (mean particle diameter: 10 μm) was added to the iron-based powders at a predetermined ratio, and the resultant powders were mixed for 15 minutes in a V blender, then subjected to heat treatment in a hydrogen atmosphere with a dew point of 30° C. (holding temperature: 880° C., holding time: 1 h). Mo of a predetermined amount presented in Table 1 was then adhered to the surface of the particles of the iron-based powders by diffusion bonding to produce partially alloyed steel powders for powder metallurgy. Note that the Mo content was varied as in Samples Nos. 1 to 8 presented in Table 1.

The produced partially alloyed steel powders were each embedded into a resin and polishing was performed to expose a cross section of the partially alloyed steel powder particles. Specifically, the partially alloyed steel powders were each embedded to be uniformly distributed in an area with a thickness of 0.5 mm or more in a thermosetting resin so that a cross section of a sufficient number of partially alloyed steel powder particles can be observed in the polished surface, that is, the observation surface. After the polishing, the polished surface was magnified and imaged by an optical microscope, and the circularity of the particles was calculated by image analysis as described above.

Further, the specific surface area of the partially alloyed steel powder particles was measured through BET theory. The particles of each partially alloyed steel powder were confirmed to have a specific surface area of less than 0.10 $m^2/g$.

Subsequently, Cu powder of the mean particle diameter and amount presented in Table 1 and graphite powder (mean particle diameter: 5 μm) of the amount listed in Table 1 were added to and mixed with each partially alloyed steel powder, to produce a mixed powder for powder metallurgy. The particle diameter of the Cu powder in Table 1 is a value measured by the above-mentioned method.

Samples Nos. 9 to 25 used partially alloyed steel powder equivalent to those used in Sample No. 5, yet the amounts of Cu powders and graphite powders varied. Samples Nos. 26 to 31 used basically the same partially alloyed steel powder as that of Sample No. 5, of which mean particle diameter was adjusted by sieving. Further, Samples Nos. 32 to 38 used partially alloyed steel powders having circularities that varied.

After that, 0.6 parts by mass ethylenebisstearamide was added with respect to 100 parts by mass the resulting mixed powder for powder metallurgy, and the resulting powder was then mixed in a V-shaped mixer for 15 minutes, thereby manufacturing bar-shaped green compacts having length: 55 mm, width: 10 mm, and thickness: 10 mm and ring-shaped green compacts having outer diameter: 38 mm, inner diameter: 25 mm, and thickness: 10 mm (ten pieces each).

The bar-shaped green compacts and the ring-shaped green compacts were sintered thereby obtaining sintered bodies. The sintering was performed under a set of conditions including sintered temperature: 1130° C. and sintering time: 20 min in a propane converted gas atmosphere.

The measurement of outer diameter, inner diameter, and thickness and mass measurement were performed on the ring-shaped sintered bodies, thereby calculating the sintered body density ($Mg/m^3$).

For the bar-shaped sintered bodies, five of them were worked into round bar tensile test pieces (JIS No. 2), each having a parallel portion with a diameter of 5 mm, to be subjected to the tensile test according to JIS Z2241, and the other five were bar shaped (unnotched) as sintered and had a size according to JIS Z2242 to be subjected to the Charpy impact test according to JIS Z2242. Each of these test pieces was subjected to gas carburizing at carbon potential: 0.8 mass % (holding temperature: 870° C., holding time: 60 min) followed by quenching (60° C., oil quenching) and tempering (holding temperature: 180° C., holding time: 60 min).

The round bar tensile test pieces and bar-shaped test pieces for the Charpy impact test subjected to carburizing, quenching, and tempering were subjected to the tensile test according to JIS Z2241 and the Charpy impact test according to JIS Z2242; thus, the tensile strength (MPa) and the impact energy value ($J/cm^2$) were measured and the mean values were calculated with the number of samples n=5.

The measurement results are also presented in Table 1. The evaluation criteria are as follows.

(1) Flowability

Mixed powders for powder metallurgy: 100 g were introduced into a nozzle having diameter: 2.5 mmϕ. When the total amount of powder was completely flown within 80 s without stopping, the powder was judged to have passed (passed). When the powder required more than 80 s to be flown or the total amount or part of the amount of powder stopped and failed to be flown, the powder was judged to have failed (failed).

(2) Sintered Body Density

A sintered body density of 6.95 $Mg/m^3$ or more, that is equal to or higher than that of a conventional 4Ni material (4Ni-1.5Cu-0.5Mo, maximum particle diameter of material powder: 180 μm) was judged to have passed.

(3) Tensile Strength

When the round bar tensile test pieces having been subjected to carburizing, quenching, and tempering had a tensile strength of 1000 MPa or more, the test pieces were judged to have passed.

(4) Impact Energy Value

When the bar-shaped test pieces for the Charpy impact test having been subjected to carburizing, quenching, and tempering had an impact energy value of 14.5 J/cm$^2$ or more, the test pieces were judged to have passed.

TABLE 1

| Sample No. | Partially alloyed steel powder: Mean particle diameter (μm) | Partially alloyed steel powder: Circularity | Mo content (mass %) | Cu content (mass %) | Graphite content (mass %) | Cu particle diameter (μm) | Flowability | Sintered body density (Mg/m$^3$) | Tensile strength (MPa) | Impact energy value (J/cm$^2$) | Evaluation | Note |
|---|---|---|---|---|---|---|---|---|---|---|---|---|
| 1 | 89 | 0.58 | 0.1 | 2.0 | 0.3 | 35 | passed | 7.02 | 1080 | 13.8 | failed | Comparative Example |
| 2 | 91 | 0.60 | 0.2 | 2.0 | 0.3 | 35 | passed | 7.00 | 1125 | 14.7 | passed | Example |
| 3 | 92 | 0.61 | 0.4 | 2.0 | 0.3 | 35 | passed | 7.01 | 1150 | 15.6 | passed | Example |
| 4 | 95 | 0.62 | 0.6 | 2.0 | 0.3 | 35 | passed | 7.01 | 1175 | 15.4 | passed | Example |
| 5 | 91 | 0.58 | 0.8 | 2.0 | 0.3 | 35 | passed | 6.97 | 1185 | 15.1 | passed | Example |
| 6 | 88 | 0.63 | 1.0 | 2.0 | 0.3 | 35 | passed | 6.98 | 1195 | 14.8 | passed | Example |
| 7 | 92 | 0.63 | 1.5 | 2.0 | 0.3 | 35 | passed | 6.95 | 1200 | 14.6 | passed | Example |
| 8 | 93 | 0.62 | 2.0 | 2.0 | 0.3 | 35 | passed | 6.92 | 1230 | 13.6 | failed | Comparative Example |
| 9 | 91 | 0.58 | 0.8 | 0.2 | 0.3 | 35 | passed | 7.01 | 980 | 13.6 | failed | Comparative Example |
| 10 | 91 | 0.58 | 0.8 | 0.5 | 0.3 | 35 | passed | 7.00 | 1015 | 14.6 | passed | Example |
| 11 | 91 | 0.58 | 0.8 | 1.5 | 0.3 | 35 | passed | 6.98 | 1135 | 15.1 | passed | Example |
| 12 | 91 | 0.58 | 0.8 | 3.0 | 0.3 | 35 | passed | 6.97 | 1210 | 15.4 | passed | Example |
| 13 | 91 | 0.58 | 0.8 | 4.0 | 0.3 | 35 | passed | 6.95 | 1180 | 15.9 | passed | Example |
| 14 | 91 | 0.58 | 0.8 | 5.0 | 0.3 | 35 | passed | 6.92 | 990 | 13.0 | failed | Comparative Example |
| 15 | 91 | 0.58 | 0.8 | 2.0 | 0.05 | 35 | passed | 7.02 | 980 | 16.0 | failed | Comparative Example |
| 16 | 91 | 0.58 | 0.8 | 2.0 | 0.2 | 35 | passed | 7.00 | 1090 | 15.2 | passed | Example |
| 17 | 91 | 0.58 | 0.8 | 2.0 | 0.5 | 35 | passed | 6.98 | 1150 | 14.8 | passed | Example |
| 18 | 91 | 0.58 | 0.8 | 2.0 | 1.0 | 35 | passed | 6.97 | 1180 | 14.5 | passed | Example |
| 19 | 91 | 0.58 | 0.8 | 2.0 | 1.5 | 35 | passed | 6.97 | 1115 | 12.0 | failed | Comparative Example |
| 20 | 91 | 0.58 | 0.8 | 2.0 | 0.3 | 55 | passed | 6.95 | 1110 | 14.5 | passed | Example |
| 21 | 91 | 0.58 | 0.8 | 2.0 | 0.3 | 48 | passed | 6.96 | 1164 | 14.6 | passed | Example |
| 22 | 91 | 0.58 | 0.8 | 2.0 | 0.3 | 30 | passed | 6.98 | 1151 | 15.1 | passed | Example |
| 23 | 91 | 0.58 | 0.8 | 2.0 | 0.3 | 24 | passed | 6.99 | 1160 | 15.1 | passed | Example |
| 24 | 91 | 0.58 | 0.8 | 2.0 | 0.3 | 15 | passed | 7.00 | 1180 | 15.2 | passed | Example |
| 25 | 91 | 0.58 | 0.8 | 2.0 | 0.3 | 1.5 | passed | 7.03 | 1210 | 15.6 | passed | Example |
| 26 | 128 | 0.48 | 0.8 | 2.0 | 0.3 | 35 | passed | 6.93 | 1110 | 14.0 | failed | Comparative Example |
| 27 | 118 | 0.55 | 0.8 | 2.0 | 0.3 | 35 | passed | 6.98 | 1150 | 14.7 | passed | Example |
| 28 | 98 | 0.57 | 0.8 | 2.0 | 0.3 | 35 | passed | 7.00 | 1135 | 15.4 | passed | Example |
| 29 | 75 | 0.58 | 0.8 | 2.0 | 0.3 | 35 | passed | 7.01 | 1194 | 15.7 | passed | Example |
| 30 | 60 | 0.59 | 0.8 | 2.0 | 0.3 | 35 | passed | 7.01 | 1230 | 16.0 | passed | Example |
| 31 | 35 | 0.62 | 0.8 | 2.0 | 0.3 | 35 | passed | 6.99 | 1260 | 16.3 | passed | Example |
| 32 | 28 | 0.64 | 0.8 | 2.0 | 0.3 | 35 | failed | — | — | — | failed | Comparative Example |
| 33 | 70 | 0.45 | 0.8 | 2.0 | 0.3 | 35 | passed | 7.01 | 1240 | 16.4 | passed | Example |
| 34 | 69 | 0.54 | 0.8 | 2.0 | 0.3 | 35 | passed | 7.00 | 1213 | 16.1 | passed | Example |
| 35 | 72 | 0.56 | 0.8 | 2.0 | 0.3 | 35 | passed | 6.99 | 1180 | 15.9 | passed | Example |
| 36 | 69 | 0.60 | 0.8 | 2.0 | 0.3 | 35 | passed | 7.00 | 1140 | 15.0 | passed | Example |
| 37 | 70 | 0.62 | 0.8 | 2.0 | 0.3 | 35 | passed | 6.97 | 1120 | 14.7 | passed | Example |
| 38 | 71 | 0.67 | 0.8 | 2.0 | 0.3 | 35 | passed | 6.98 | 1001 | 12.0 | failed | Comparative Example |
| 39* | 65 | 0.67 | 0.5 | — | 0.3 | 35 | passed | 6.97 | 998 | 13.3 | failed | Comparative Example |

Sample No. 39 is a 4Ni material (Fe-4Ni-1.5Cu-0.5Mo)

Samples Nos. 1 to 8 were designed for evaluating the effect of the Mo content, Nos. 9 to 14 for evaluating the effect of the Cu content, Nos. 15 to 19 for evaluating the effect of the graphite content, Nos. 20 to 25 for evaluating the effect of the Cu particle diameter, Nos. 26 to 31 for evaluating the effect of the alloyed particle diameter, and Nos. 32 to 38 for evaluating the effect of the circularity and the mean particle diameter of the partially alloyed steel powders. Table 1 also presents the results of a 4Ni material (4Ni-1.5Cu-0.5Mo, maximum particle diameter of material powder: 180 μm) as the conventional material. The table demonstrates that our examples exhibited better properties over the conventional 4Ni material.

As presented in Table 1, all of Examples of this disclosure were, despite the mixed powder for powder metallurgy having a chemical system not using Ni, mixed powders for powder metallurgy yielding sintered bodies with at least as high tensile strength and toughness as in the case of using a Ni-added material.

Moreover, in all of Examples of this disclosure, the alloy steel powder exhibited excellent flowability.

Example 2

The following experiment was conducted in order to clarify the technical differences between our examples and PTL 3.

Three atomized iron powders having particles of different specific surface areas and circularities were prepared. The specific surface area and the circularity were adjusted by grinding each atomized iron powder using a high speed mixer (LFS-GS-2J manufactured by Fukae Powtec Corp.) and adjusting the mixing ratio of coarse powder having a particle size of 100 μm or more and fine powder having a particle size of 45 μm or less.

Oxidized Mo powder (mean particle diameter: 10 μm) was added to the iron-based powders at a predetermined ratio, and the resultant powders were mixed for 15 minutes in a V blender, then subjected to heat treatment in a hydrogen atmosphere with a dew point of 30° C. (holding temperature: 880° C., holding time: 1 h). Mo of a predetermined amount presented in Table 2 was then adhered to the surface of the particles of the iron-based powders by diffusion bonding to produce partially alloyed steel powders for powder metallurgy. These partially alloyed steel powders were each embedded into a resin and polishing was performed to expose a cross section of the partially alloyed steel powder particles. Subsequently, the cross section was magnified and imaged by an optical microscope, and the circularity of the particles was calculated by image analysis. Further, the specific surface area of the partially alloyed steel powder particles was measured through BET theory.

having outer diameter: 38 mm, inner diameter: 25 mm, and thickness: 10 mm (ten pieces each).

The bar-shaped green compacts and ring-shape green compacts were sintered to obtain sintered bodies. The sintering was performed under a set of conditions including sintered temperature: 1130° C. and sintering time: 20 min in a propane converted gas atmosphere.

The measurement of outer diameter, inner diameter, and thickness and mass measurement were performed on the ring-shaped sintered bodies, thereby calculating the sintered body density ($Mg/m^3$).

For the bar-shaped sintered bodies, five of them were worked into round bar tensile test pieces (JIS No. 2) having diameter: 5 mm to be subjected to the tensile test according to JIS Z2241, and the other five were bar shaped (unnotched) as sintered with a size as specified in JIS Z 2242 to be subjected to the Charpy impact test according to JIS Z2242. Each of these test pieces was subjected to gas carburizing at carbon potential: 0.8 mass % (holding temperature: 870° C., holding time: 60 min) followed by quenching (60° C., oil quenching) and tempering (holding temperature: 180° C., holding time: 60 min).

The round bar tensile test pieces and bar-shaped test pieces for the Charpy impact test subjected to carburizing, quenching, and tempering were subjected to the tensile test according to JIS Z2241 and the Charpy impact test according to JIS Z2242; thus, the tensile strength (MPa) and the impact energy value ($J/cm^2$) were measured and the mean values were calculated with the number of samples n=5.

The measurement results are also presented in Table 2. The acceptance criteria for the values of the properties were the same as those in Example 1.

TABLE 2

| | Partially alloyed steel powder | | | | | | | | | | | | |
|---|---|---|---|---|---|---|---|---|---|---|---|---|---|
| Sample No. | Mean particle diameter (μm) | Circularity | Specific surface area ($m^2/g$) | Mo content (mass %) | Cu content (mass %) | Graphite content (mass %) | Cu particle diameter (μm) | Flowability | Sintered body density ($Mg/m^3$) | Tensile strength (MPa) | Impact energy value ($J/cm^2$) | Evaluation | Note |
| 40 | 78 | 0.55 | 0.07 | 0.4 | 2.0 | 0.3 | 35 | passed | 7.01 | 1175 | 15.1 | passed | Example |
| 41 | 76 | 0.52 | 0.08 | 0.8 | 2.0 | 0.3 | 35 | passed | 6.97 | 1194 | 15.7 | passed | Example |
| 42 | 76 | 0.59 | 0.13 | 0.4 | 2.0 | 0.3 | 35 | failed | — | — | — | failed | Comparative Example |
| 43 | 77 | 0.52 | 0.15 | 0.8 | 2.0 | 0.3 | 35 | failed | — | — | — | failed | Comparative Example |
| 44 | 76 | 0.67 | 0.12 | 0.4 | 2.0 | 0.3 | 35 | failed | — | — | — | failed | Comparative Example |
| 45 | 77 | 0.66 | 0.14 | 0.8 | 2.0 | 0.3 | 35 | failed | — | — | — | failed | Comparative Example |
| 46 | 75 | 0.68 | 0.06 | 0.4 | 2.0 | 0.3 | 35 | passed | 7.10 | 1060 | 12.1 | failed | Comparative Example |
| 47 | 77 | 0.69 | 0.08 | 0.8 | 2.0 | 0.3 | 35 | passed | 7.06 | 1075 | 12.3 | failed | Comparative Example |

Next, 2 mass % of Cu powder having a mean particle diameter of 35 μm and 0.3 mass % of graphite powder (mean particle diameter: 5 μm) were added to and mixed in these partially alloyed steel powders to produce a mixed powder for powder metallurgy. Ethylenebisstearamide was then added in an amount of 0.6 parts by mass to the resulting mixed powder for powder metallurgy: 100 parts by mass, and the powder was then mixed in a V blender for 15 minutes. Each of the mixed powders was compacted at a compacting pressure of 686 MPa, thereby manufacturing bar-shaped green compacts having length: 55 mm, width: 10 mm, and thickness: 10 mm and ring-shaped green compacts As can be seen from Table 2, only the samples having a specific surface area in the range according to this disclosure had good fluidity. Moreover, when the circularity was high, the impact value was low.

The invention claimed is:

1. A mixed powder for powder metallurgy, comprising:

a partially diffusion alloyed steel powder in which Mo diffusionally adheres to a particle surface of an iron-based powder;

a Cu powder; and a graphite powder, wherein the mixed powder for powder metallurgy has a chemical composition containing Mo in an amount of 0.2 mass % to 1.5 mass %, Cu in an amount of 0.5 mass % to 4.0 mass %, and C in an amount of 0.1 mass % to 1.0 mass %, with the balance consisting of Fe and inevitable impurities, and the partially diffusion alloyed steel powder has: a mean particle diameter of 30 μm to 120 μm; a specific surface area of less than 0.10 $m^2/g$; and a circularity of particles thereof with a diameter in a range from 50 μm to 100 μm of 0.65 or less.

2. The mixed powder for powder metallurgy according to claim 1, wherein the Cu powder has a mean particle diameter of 50 μm or less.

3. The mixed powder for powder metallurgy according to claim 1, wherein the iron-based powder is at least one of an as-atomized powder and an atomized iron powder.

4. The mixed powder for powder metallurgy according to claim 2, wherein the iron-based powder is at least one of an as-atomized powder and an atomized iron powder.

5. A sintered body formed by sintering a green compact that comprises the mixed powder for powder metallurgy according to claim 1.

6. A sintered body formed by sintering a green compact that comprises the mixed powder for powder metallurgy according to claim 2.

7. A sintered body formed by sintering a green compact that comprises the mixed powder for powder metallurgy according to claim 3.

8. A sintered body formed by sintering a green compact that comprises the mixed powder for powder metallurgy according to claim 4.

9. A method of producing a sintered body, comprising sintering a green compact of a mixed powder for powder metallurgy that includes: a partially diffusion alloyed steel powder in which Mo diffusionally adheres to a particle surface of an iron-based powder; a Cu powder; and a graphite powder, wherein the mixed powder for powder metallurgy has a chemical composition containing Mo in an amount of 0.2 mass % to 1.5 mass %, Cu in an amount of 0.5 mass % to 4.0 mass %, and C in an amount of 0.1 mass % to 1.0 mass %, with the balance consisting of Fe and inevitable impurities, and the partially diffusion alloyed steel powder has: a mean particle diameter of 30 μm to 120 μm; a specific surface area of less than 0.10 $m^2/g$; and a circularity of particles thereof with a diameter in a range from 50 μm to 100 μm of 0.65 or less.

10. The method of producing a sintered body according to claim 9, wherein the Cu powder has a mean particle diameter of 50 μm or less.

11. The method of producing a sintered body according to claim 9, wherein the iron-based powder is at least one of an as-atomized powder and an atomized iron powder.

12. The method of producing a sintered body according to claim 10, wherein the iron-based powder is at least one of an as-atomized powder and an atomized iron powder.

13. The mixed powder for powder metallurgy according to claim 1, wherein the circularity is 0.52 or more and 0.65 or less.

14. The mixed powder for powder metallurgy according to claim 2, wherein the circularity is 0.52 or more and 0.65 or less.

15. The mixed powder for powder metallurgy according to claim 1, wherein the Cu powder has a mean particle diameter of 30 μm or more.

16. The mixed powder for powder metallurgy according to claim 2, wherein the Cu powder has a mean particle diameter of 30 μm or more.

* * * * *